US006800811B1

(12) United States Patent
Boucino

(10) Patent No.: US 6,800,811 B1
(45) Date of Patent: Oct. 5, 2004

(54) COMMUNICATIONS CABLES WITH ISOLATORS

(75) Inventor: Thomas Boucino, Mooresville, NC (US)

(73) Assignee: Commscope Properties, LLC, Sparks, NV (US)

( * ) Notice: Subject to any disclaimer, the term of this patent is extended or adjusted under 35 U.S.C. 154(b) by 0 days.

(21) Appl. No.: 09/591,349

(22) Filed: Jun. 9, 2000

(51) Int. Cl.[7] ..... H01B 11/06
(52) U.S. Cl. ..... 174/113 C
(58) Field of Search ..... 174/113 R, 113 C, 174/131 A, 27, 113 AS

(56) References Cited

U.S. PATENT DOCUMENTS

| | | | | |
|---|---|---|---|---|
| 483,285 | A | 9/1892 | Guilleaume | |
| 1,977,209 | A | 10/1934 | Sargent | 173/264 |
| 2,204,737 | A | 6/1940 | Swallow et al. | 174/28 |
| 2,340,926 | A | 2/1944 | Bradley | 138/77 |
| 3,588,313 | A | 6/1971 | Delves-Broughton | 174/28 |
| 3,603,715 | A | 9/1971 | Eilhardt et al. | 174/15 |
| 3,621,118 | A | 11/1971 | Bunish et al. | 174/115 |
| 3,927,247 | A | 12/1975 | Timmons | 174/36 |
| 4,038,489 | A | 7/1977 | Stenson et al. | 174/70 |
| 4,132,854 | A | 1/1979 | Kemeny et al. | 174/27 |
| 4,374,881 | A | 2/1983 | Hamilton | 428/36 |
| 4,683,349 | A | 7/1987 | Takebe | 174/69 |
| 4,729,409 | A | 3/1988 | Paul | 138/115 |
| 4,731,506 | A | 3/1988 | Lee | 174/115 |
| 4,778,246 | A | 10/1988 | Carroll | 350/96.23 |
| 5,132,488 | A | 7/1992 | Tessier et al. | 174/34 |
| 5,227,585 | A | 7/1993 | Zen | 174/95 |
| 5,236,016 | A | 8/1993 | Vogelsang | 138/115 |
| 5,305,797 | A | 4/1994 | Roy, Sr. | 138/108 |
| 5,493,071 | A | 2/1996 | Newmoyer | 174/113 |
| 5,541,361 | A | 7/1996 | Friesen et al. | 174/34 |
| 5,574,250 | A | 11/1996 | Hardie et al. | 174/36 |
| 5,619,016 | A | 4/1997 | Newmoyer | 174/113 |
| 5,661,836 | A | 8/1997 | Sano et al. | 385/111 |
| 5,789,711 | A | 8/1998 | Gaeris et al. | 174/113 |
| 5,969,295 | A | 10/1999 | Boucino et al. | 174/113 |
| 6,023,903 | A * | 2/2000 | Stecker | 52/740.1 |
| 6,074,503 | A | 6/2000 | Clark et al. | 156/50 |
| 6,297,454 | B1 * | 10/2001 | Gareis | 174/113 C |
| 6,342,678 | B1 | 1/2002 | Knop et al. | |
| 6,566,605 | B1 | 5/2003 | Prudhon | 174/113 C |

FOREIGN PATENT DOCUMENTS

| | | | |
|---|---|---|---|
| DE | 24 59 844 | 7/1976 | H01B/11/20 |
| GB | 2 161 656 A | 1/1986 | H02G/3/04 |
| JP | 4-332406 A * | 11/1992 | |
| JP | 405101711 | 4/1993 | H01B/7/02 |
| SU | 1343447 A1 | 10/1987 | H01B/11/02 |
| WO | WO 01 54139 | 7/2001 | |

OTHER PUBLICATIONS

Advertisement in Introducing Hi–Net Supra™; "For clean, high speed data transfer, our new Hi–Net *Supra* leaves all other cables in the dust" Circle No. 7. No date.

Advertisement in Wandel & Goltermann; Whatever the future brings we've got your network covered Circle No. 8. Nov. 1997.

EPO Search Report.

* cited by examiner

*Primary Examiner*—Chau N. Nguyen
(74) *Attorney, Agent, or Firm*—Myers Bigel Sibley & Sajovec

(57) ABSTRACT

Communications cables are provided which utilize a cable jacket, twisted pairs of insulated conductors of insulated conductors, and a spacer separating the twisted pairs of insulated conductors. The spacer extends within the cable jacket and has a longitudinally extending center portion and a plurality of wall portions radiating from the center portion thereby defining a plurality of compartments within the cable jacket. In various embodiments of the present invention, the plurality of wall portions include a plurality of radiating sections with varying geometric shapes. The twisted pairs of insulated conductors are disposed in the compartments which may reduce crosstalk in the communications cable.

24 Claims, 8 Drawing Sheets

COMMUNICATIONS CABLES WITH ISOLATORS

FIELD OF THE INVENTION

The present invention relates broadly to communications cable and more particularly, to communications cable containing at least one twisted pair of insulated conductors.

BACKGROUND OF THE INVENTION

Insulated conductors such as those used in communications cable are often provided as twisted pairs of insulated conductors having two insulated conductors twisted about each other to form a two conductor group. A typical assembly for these communications cables comprises two or more twisted pairs of insulated conductors bundled together and contained in a cable jacket. This assembly can facilitate the installation of the cable. In addition, the cable can be connected to other cable components by stripping the cable jacket and making the proper connections between the insulated conductors.

One problem associated with communications cable produced with the conventional twisted pair assembly is that crosstalk can occur between twisted pairs of insulated conductors that can negatively affect the signals transmitted by these conductors. Crosstalk may especially present a problem in high frequency applications because crosstalk may increase logarithmically as the frequency of the transmission increases. Because crosstalk is affected to some degree by the distance between twisted pairs of insulated conductors, one method of reducing its occurrence is to space the twisted pairs of insulated conductors apart using a spacing means. An example of such spacing means can be found in U.S. Pat. No. 5,789,711 to Gaeris et al. which discloses a high performance data cable which has an interior support or star separator. Another example of such a spacing means can be found in U.S. Pat. No. 5,969,295 to the present inventor Boucino, et al., ("the '295 patent") which discloses a communications cable that includes a cable jacket, twisted pairs of insulated conductors, and a spacer separating the twisted pairs of insulated conductors. The spacer in the '295 patent extends within the cable jacket and has a longitudinally extending center portion and a plurality of wall portions radiating from the center portion thereby defining a plurality of compartments within the cable jacket.

SUMMARY OF THE INVENTION

According to embodiments of the present invention, communications cables are provided which utilize a cable jacket, twisted pairs of insulated conductors, and a spacer separating the twisted pairs of insulated conductors. The spacer extends within the cable jacket and has a longitudinally extending center portion and a plurality of wall portions radiating from the center portion thereby defining a plurality of compartments within the cable jacket. In various embodiments of the present invention, the plurality of wall portions include a plurality of radiating sections with varying geometric shapes. The twisted pairs of insulated conductors are disposed in the compartments.

In embodiments of the present invention, communications cables include a cable jacket, a spacer extending within the cable jacket and having a longitudinally extending center portion and plurality of longitudinally extending wall portions radiating from the center portion that increase in thickness from the center portion to the cable jacket. The spacer and the cable jacket define a plurality of compartments within the cable jacket. One or more twisted pairs of insulated conductors are disposed in one or more of the plurality of compartments. The communications cable may also have a shield extending between the spacer and the cable jacket. The twisted pairs of insulated conductors may each have a different lay length. The plurality of longitudinally extending wall portions may be configured so as to define a plurality of compartments of a helical configuration within the cable jacket and the plurality of twisted pairs of insulated conductors located within the plurality of compartments may extend helically about the longitudinal axis of the cable.

In other embodiments of the present invention, the plurality of longitudinally extending wall portions may increase in thickness over only a portion thereof from the center portion to the cable jacket.

In further embodiments of the present invention, the plurality of longitudinally extending wall portions may decrease in thickness over only a portion thereof from the center portion to the cable jacket.

In still further embodiments of the present invention, the longitudinally extending wall portions have a first radial section that increases in thickness with distance from the center portion and a second radial section that decreases in thickness with distance from the center portion. The first radial section may be located between the center portion and the second radial section or the second radial section be may located between the center portion and the first radial section. The first radial section and the second radial section may be configured such that the plurality of longitudinally extending wall portions have a convex shaped cross-section that may be arcuate and/or include a plurality of faces. The first radial section and the second radial section may also be configured such that the plurality of longitudinally extending wall portions have a concave shaped cross-section that may be arcuate and/or include a plurality of faces. The first radial section and second radial section may further be configured such that the plurality of longitudinally extending wall portions have a recessed portion and/or a ribbed portion.

In still other embodiments of the present invention, the longitudinally extending wall portions may have a first section having a first thickness, a second section having a second thickness and a third section having a third thickness and located between the first section and the second section. The third thickness is different from the first and second thickness. In one embodiment, the first thickness, the second thickness and the thickness of the third section are all different. In another embodiment, the first thickness and the second thickness may be the same and the third thickness may be either thicker or thinner than the first thickness.

In still further embodiments of the present invention, the longitudinally extending wall portions may have a sawtooth shaped cross-section having a plurality of teeth. Each tooth may have a tooth height and a tooth spacing. In one embodiment, each tooth height is the same. In other embodiments, at least two tooth heights are different. In yet other embodiments, each tooth spacing is the same. In still other embodiments, at least two tooth spacings are different. In other embodiments, at least two tooth heights are different and at least two tooth spacings are different.

In still other embodiments of the present invention, the longitudinally extending wall portions may have a first radial section and a second radial section having a knob shaped cross-section. The knob shaped cross-section may be any portion of a knob including a half knob and/or a whole knob.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein. Instead, these embodiments are provided so that this disclosure will be thorough and complete, and will fully convey the scope of the invention to those skilled in the art. It will be understood that when an element (e.g., cable jacket) is referred to as being "connected to" another element, it can be directly connected to the other element or intervening elements may also be present. In contrast, when an element is referred to as being "directly connected to" another element, there are no intervening elements present. Like numbers refer to like elements throughout.

Figure 1:
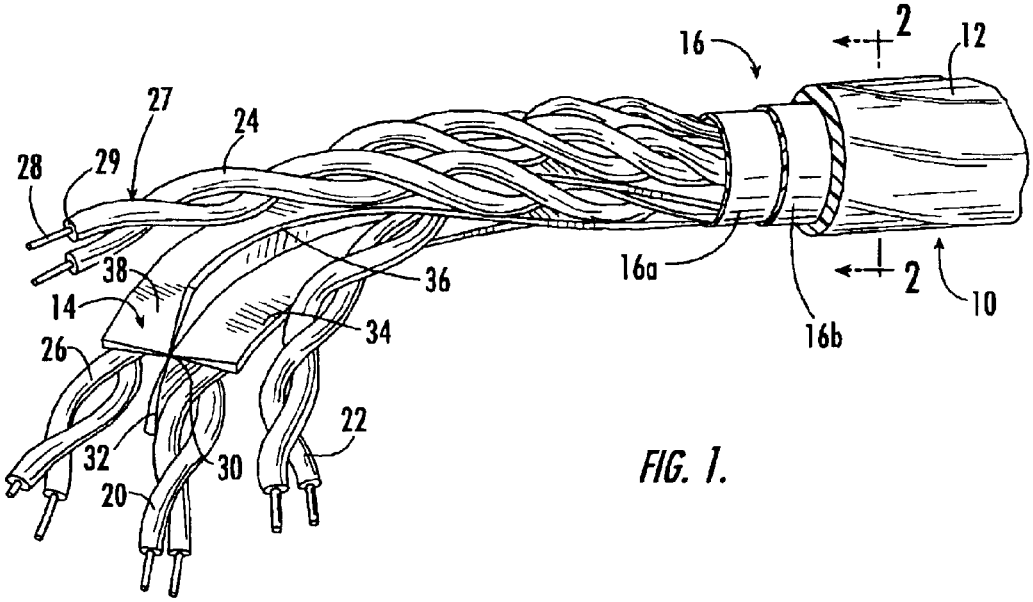
FIG. 1 is a perspective view of embodiments of communications cables of the present invention.
Figure 2:
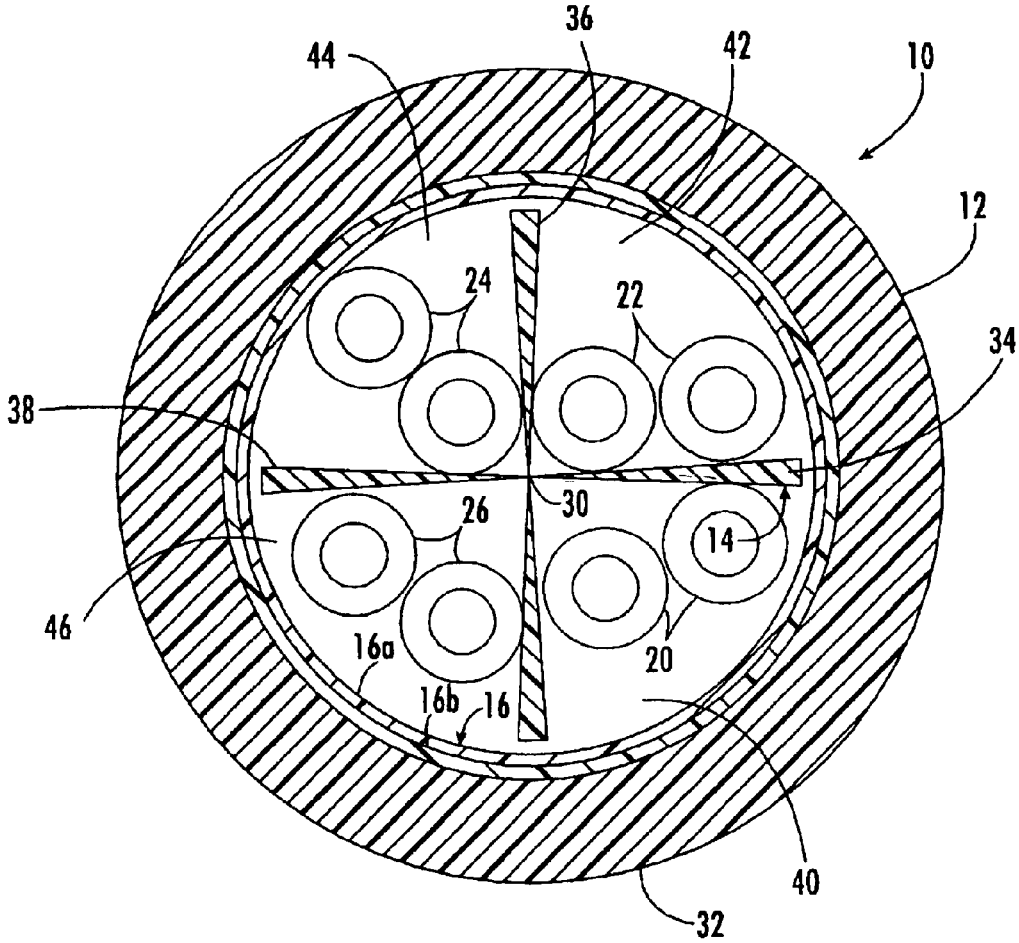
FIG. 2 is a cross-sectional view of communications cables of FIG. 1 taken along line 2—2.

Referring now to FIGS. 1 and 2, embodiments of communications cables according to the present invention will now be described. The illustrated communications cable 10 includes a cable jacket 12, a spacer 14, a plurality of twisted pairs of insulated conductors 20, 22, 24, 26, a shield 16 and a plurality of compartments 40, 42, 44, 46. The cable jacket 12 surrounds the spacer 14, the shield 16 and the twisted pairs 20, 22, 24, 26 and is preferably tubular in shape. Preferably, the cable jacket 12 is made of a flexible polymer material and is formed by melt extrusion. As will be understood by those of skill in the art, any of the polymer materials conventionally used in cable construction may be suitably employed including, but not limited to, polyvinylchloride, polyvinylchloride alloys, polyethylene, polypropylene and flame retardant materials such as fluorinated polymers. Moreover, other materials and/or fabrication methods may be used. Preferably, the cable jacket 12 is extruded to a thickness of between 15 and 25 mils (thousandths of an inch) which may facilitate stripping the cable jacket 12 away from the twisted pairs 20, 22, 24, 26. However, other dimensions may be used.

With reference to FIG. 1, the shield 16 is located between the spacer 14 and the cable jacket 12 and is preferably longitudinally coextensive with the cable jacket 12. The shield 16 may be made from a wide variety of known conductive and/or nonconductive materials such as nonconductive polymeric tape; conductive tape; braid; a combination of nonconductive polymeric tape, conductive tape and/or braid; and/or other such materials as will be understood to one of skill in the art using conventional fabrication techniques. The shield 16 may include one or more layers of material 16*a*, 16*b* and may be applied longitudinally, helically, etc. and/or may be braided as will be understood to one of skill in the art. As will be understood by one of skill in the art, the shield 16 can be omitted from the communications cable 10.

As shown in FIG. 1, the spacer 14 is situated within and is longitudinally coextensive with the cable jacket 12. As illustrated in FIG. 2, the spacer 14 includes a longitudinally extending center portion 30 and a plurality of longitudinally extending wall portions 32, 34, 36, 38 radiating from the center portion 30. As illustrated in FIG. 2, the wall portions 32, 34, 36, 38 preferably increase in thickness from the center portion 30 to the cable jacket 12. The spacer 14 and the cable jacket 12 may define a plurality of compartments 40, 42, 44, 46 in which the twisted pairs 20, 22, 24, 26 may be located. Alternatively, the plurality of compartments may be defined by the spacer 14 and the shield 16. Each of the compartments 40, 42, 44, 46 is preferably of sufficient size to receive a corresponding twisted pair 20, 22, 24, 26. The communications cable 10 preferably has at least four compartments 40, 42, 44, 46 to receive at least four respective twisted pairs 20, 22, 24, 26. Although the illustrated communications cable 10 has four compartments 40, 42, 44, 46 which can receive four twisted pairs 20, 22, 24, 26, it will be understood by those skilled in the art that the communications cable 10 may have two, three, four or more compartments 40, 42, 44, 46 for receiving a plurality of twisted pairs 20, 22, 24, 26 and that every compartment 40, 42, 44, 46 need not include a twisted pair 20, 22, 24, 26.

As shown in FIG. 1, the insulated conductors 27 of each twisted pair 20, 22, 24, 26 are twisted helically around one another. Preferably, the twisted pairs 20, 22, 24, 26 are typically twisted at a lay length of between about 0.25 and about 1.50 inches and each of the twisted pairs 20, 22, 24, 26 preferably has a different lay length from any other twisted pair 20, 22, 24, 26 of the communications cable 10.

As shown in FIG. 1 with reference to only one twisted pair 24 for purposes of illustration, each insulated conductor 27 in the twisted pair 24 comprises a conductor 28 surrounded by a layer of an insulated material 29. The conductor 28 may be a metallic wire of any of the well-known metallic conductors used in wire and cable applications, such as copper, aluminum, copper-clad aluminum and/or copper-clad steel. Preferably, the wire is 18 to 26 AWG gauge. The conductor 28 is surrounded by a layer of the insulating material 29. Preferably, the thickness of the insulating material 29 is less than about 25 mil, preferably less than about 15 mil, and for certain applications even less than about 10 mil. The insulating material 29 may also be foamed or expanded through the use of a blowing or foaming agent. Suitable insulating materials for the insulated conductor 27 include polyvinylchloride, polyvinylchloride alloys, polyethylene, polypropylene, and flame retardant materials such as fluorinated polymers. Exemplary fluorinated polymers for use in the invention include fluorinated ethylene-propylene (FEP), ethylenetrifluoroethylene (ETFE), ethylene chlorotrifluoroethylene (ECTFE), perfluoroalkoxypolymers (PFA's), and mixtures thereof. Exemplary PFA's include copolymers of tetrafluoroethylene and perfluoropropylvinylether (e.g., Teflon PFA 340) and copolymers of tetrafluoroethylene and perfluoromethylvinylether (MFA copolymers which are available from Ausimont S.p.A.). In addition, the insulating material 29 can contain conventional additives such as pigments, nucleating agents, thermal stabilizers, acid acceptors, processing aids, and/or flame retardant compositions (e.g., antimony oxide). If desired, the insulating material 29 used for the insulated conductor 27 may not be the same for each twisted pair 20, 22, 24, 26. For example, three of the twisted pairs 20, 22, 24, 26 may be constructed using a foamed polyvinylchloride insulating material 29 while the fourth twisted pair 20, 22, 24, 26 is constructed using a different insulating material 29 such as a foamed FEP. Other materials, dimensions and/or fabrication techniques for the conductors and/or insulating materials 29 may be used.

As shown in FIG. 1, the wall portions 32, 34, 36, 38 of the communications cable 10 may be configured so as to define longitudinally extending passageways or compartments 40, 42, 44, 46 of a helical configuration within the cable jacket 12 so that the respective twisted pairs 20, 22, 24, 26 located within the compartments 40, 42, 44, 46 extend helically around the longitudinal axis of the communications cable 10. Typically, the spacer 14 and the twisted pairs 20, 22, 24, 26 are twisted to provide this helical configuration thereby holding these cable components together. Furthermore, this helical configuration may improve the impedance uniformity of the cable by maintaining uniformity of spacing of the respective twisted pairs 20, 22, 24, 26 despite bending of the communications cable 10. The cable components may be twisted helically at a predetermined lay length defined as the length it takes for one of the cable components (e.g., one twisted pair 20, 22, 24, 26) to make one complete helical turn. Preferably, the lay length is between about 3 and about 8 inches. However, other lay lengths may be used.

FIGS. 1 and 2 illustrate embodiments of the invention wherein the spacer 14 is separate from the shield 16. In this configuration, the wall portions 32, 34, 36, 38 radiate from the center portion 30 and terminate proximate to the shield 16. The communications cable 10 illustrated in FIGS. 1 and 2 may be manufactured by extruding the spacer 14 using a suitable polymer material, such as the materials described above for use in the cable jacket 12. The spacer 14 may also comprise conductors such as metal and/or semiconductors such as carbon. The spacer 14 may be formed into a desired shape as it exits the extruder and is cooled or quenched to harden the spacer 14. The spacer 14 may then be bunched with four twisted pairs 20, 22, 24, 26 such that the twisted pairs 20, 22, 24, 26 are oriented in the compartments 40, 42, 44, 46 of the spacer 14. The spacer 14 and the twisted pairs 20, 22, 24, 26 may also be twisted helically during the bunching process which may increase the impedance uniformity of the communications cable 10. Once the spacer 14 and the twisted pairs 20, 22, 24, 26 are bunched, the shield 16 may be applied and the cable jacket 12 may then be extruded around the shield 16, spacer 14 and twisted pairs 20, 22, 24, 26 to form the communications cable 10. Other manufacturing techniques may also be used.

Although the spacer 14 of the embodiment of FIGS. 1 and 2 is not connected to the shield 16, the wall portions 32, 34, 36, 38 of the spacer 14 may be connected to the shield 16. The spacer 14 may be connected to the shield 16, for example, by designing the spacer 14 so that it extends slightly beyond the twisted pairs 20, 22, 24, 26 and constructing the shield 16 from heat bonded foil tape which, when heated through the cable jacket extrusion process, may become bonded to the spacer 14. Other manufacturing techniques may also be used.

As mentioned above, the shield 16 may be omitted from the communications cable 10. Techniques from manufacturing a communications cable without a shield, but with the spacer either connected or not connected to the cable jacket, are disclosed in U.S. Pat. No. 5,969,295 to the present inventor Boucino, et al., entitled "Twisted Pair Communications Cable," which patent is hereby incorporated by reference as if fully set forth herein.

Figure 3:
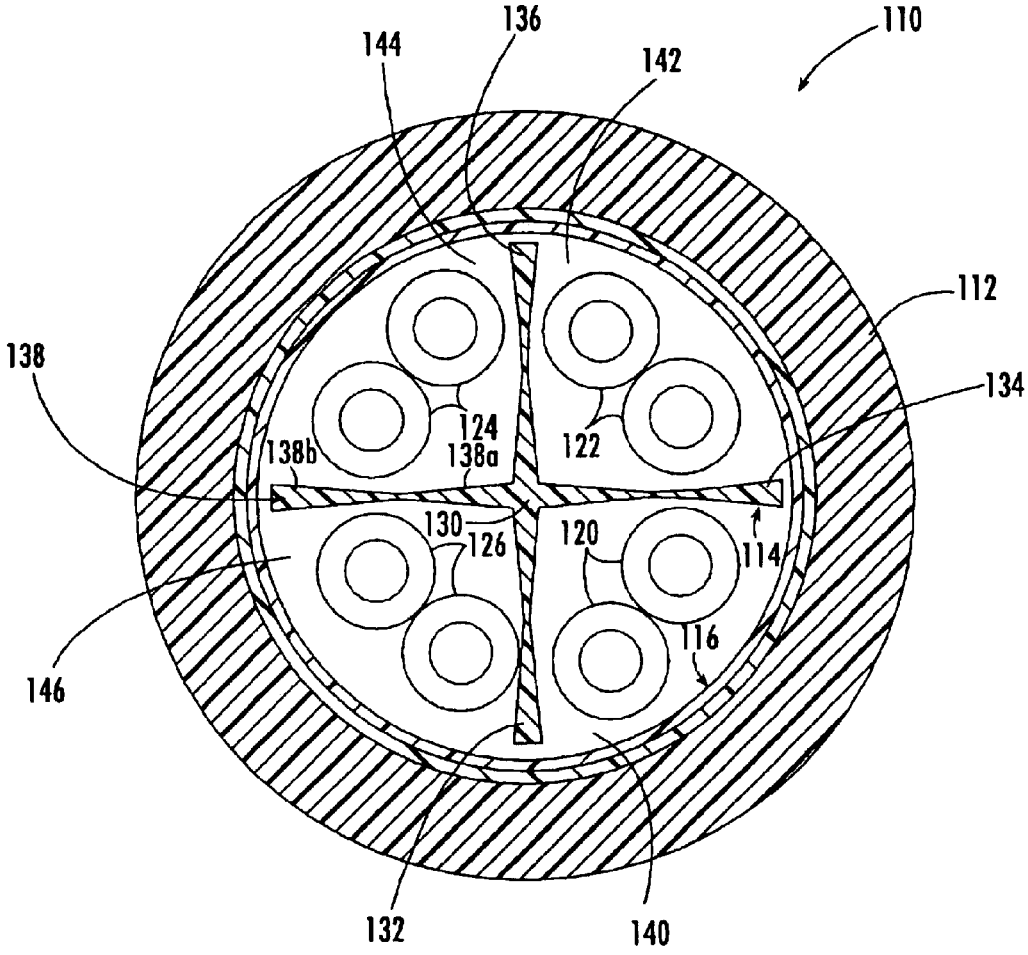
FIG. 3 is a cross-sectional view of other embodiments of communications cables according to the present invention.

With reference to FIG. 3, a communications cable 110 according to further embodiments of the present invention will now be described. The communications cable 110 includes a cable jacket 112, a spacer 114, a plurality of twisted pairs of insulated conductors 120, 122, 124, 126, a shield 116 and a plurality of compartments 140, 142, 144, 146. It will, however, be understood that the shield 116 may be omitted. The cable jacket 112, the plurality of twisted pairs of insulated conductors 120, 122, 124, 126, the shield 116 and the plurality of compartments 140, 142, 144, 146 may generally be constructed in the same manner as the cable jacket 10, the plurality of twisted pairs of insulated conductors 20, 22, 24, 26, the shield 16 and the plurality of compartments 40, 42, 44, 46 described above with reference to the communications cable 10. Accordingly, a detailed description thereof need not be repeated.

As shown in FIG. 3, the spacer 114 is situated within and is longitudinally coextensive with the cable jacket 112. The spacer 114 may comprise the same materials and may be fabricated using the same fabrication techniques that were discussed in connection with the spacer 14. As illustrated in FIG. 3, the spacer 114 includes a longitudinally extending center portion 130 and a plurality of longitudinally extending wall portions 132, 134, 136, 138 radiating from the center portion 130. Each individual wall portion 132, 134, 136, 138 preferably includes a plurality of radial sections **138*a*, 138*b* wherein each individual radial section 138*a*, 138*b* may be of constant thickness, or may increase in thickness or decrease in thickness with distance from the center portion 130. As will be understood to one of skill in the art, the change in thickness of the radial sections that increase or decrease in thickness may be linear or non-linear, and may be continuous or discontinuous. In the embodiment illustrated in FIG. 3, each wall portion 132, 134, 136, 138 includes two radial sections 138*a*, 138*b* that are configured such that the wall portions 132, 134, 136, 138 first decrease in thickness with distance from the center portion 130 and then increase in thickness with distance from the center portion 130. As used herein, the term "configured" refers to the shape of a radial section 138*a*, 138*b* and/or the location of the radial sections 138*a*, 138*b*** relative to one another.

As will be understood to one of skill in the art, the plurality of radial sections **138*a*, 138*b* may be configured to produce wall portions 132, 134, 136, 138 with a wide variety of shapes including, but not limited to, configurations where the wall portions 132, 134, 136, 138 first decrease in thickness with distance from the center portion 130 and then increase in thickness with distance from the center portion 130, configurations where the wall portions 132, 134, 136, 138 increase in thickness over only a portion thereof with the remaining portion being of constant thickness, and configurations where the wall portions 132, 134, 136, 138 decrease in thickness over only a portion thereof with remaining portion being of constant thickness. As will be understood to one of skill in the art, two or more radial sections 138*a*, 138*b*** can be used. These embodiments may allow for better control of the location of the twisted pairs within the compartments which may provide better separation between the twisted pairs which may, in turn, improve crosstalk performance at the possible expense of decreasing the flexibility of the cable, which may depend on the amount of material used in the center portion, and increasing the possibility that the wall portions may fold over against the twisted pairs which may adversely affect the impedance and return loss. These embodiments may also provide increased surface contact between the spacer and the cable jacket or, if included, the shield, which may better protect the twisted pairs during the process of stripping the cable jacket and/or shield away.

Figure 4:
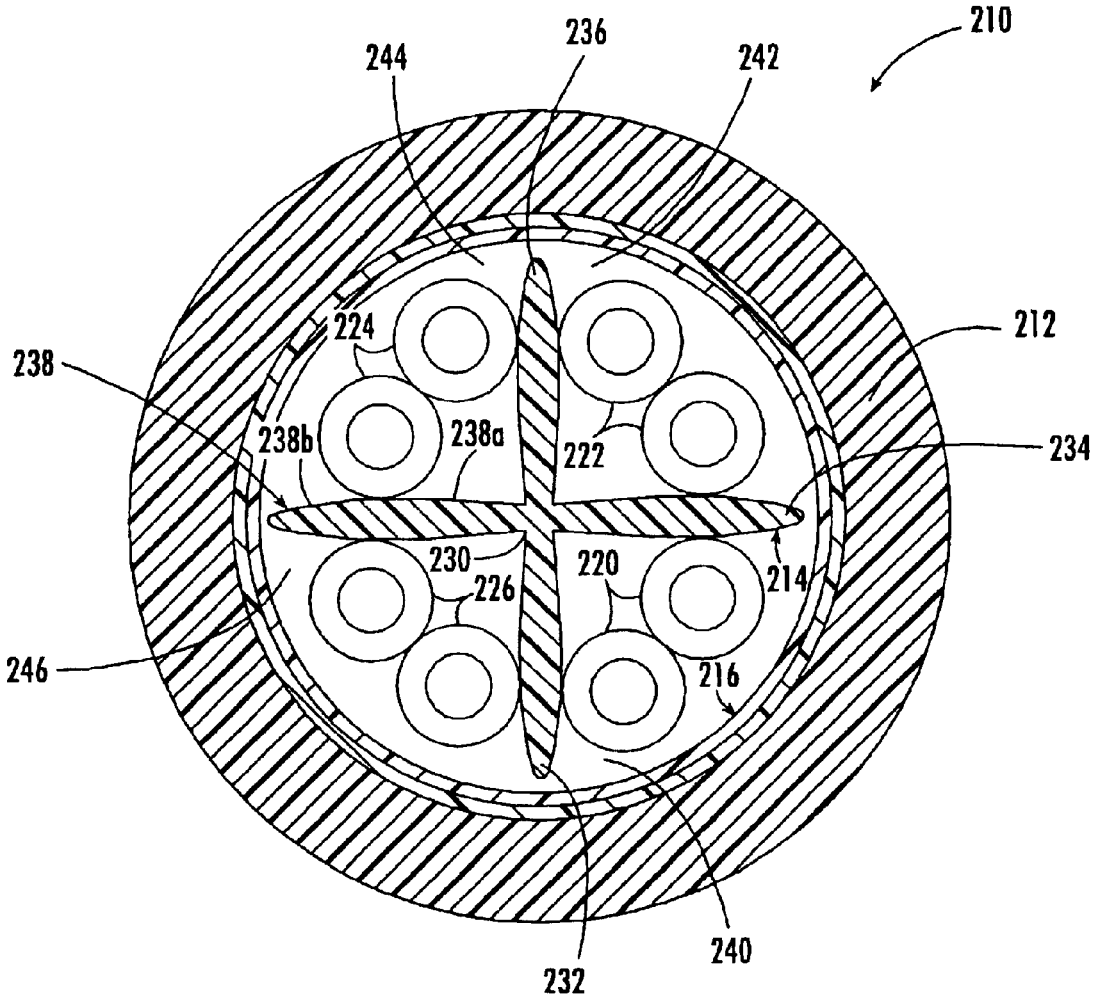
FIG. 4 is a cross-sectional view of further embodiments of communications cables according to the present invention.

With reference to FIG. 4, a communications cable 210 according to further embodiments of the present invention will now be described. The communications cable 210 includes a cable jacket 212, a spacer 214, a plurality of twisted pairs of insulated conductors 220, 222, 224, 226, a shield 216 and a plurality of compartments 240, 242, 244, 246. It will, however, be understood that the shield 216 may be omitted. The cable jacket 212, the plurality of twisted pairs of insulated conductors 220, 222, 224, 226, the shield 216 and the plurality of compartments 240, 242, 244, 246 may generally be constructed in the same manner as the cable jacket 10, the plurality of twisted pairs of insulated conductors 20, 22, 24, 26, the shield 16 and the plurality of compartments 40, 42, 44, 46 described above with reference to the communications cable 10. Accordingly, a detailed description thereof need not be repeated.

As shown in FIG. 4, the spacer 214 is situated within and is longitudinally coextensive with the cable jacket 212. The spacer 214 may comprise the same materials and may be fabricated using the same fabrication techniques that were discussed in connection with the spacer 14. As illustrated in FIG. 4, the spacer 214 includes a longitudinally extending center portion 230 and a plurality of longitudinally extending wall portions 232, 234, 236, 238 radiating from the center portion 230. Each individual wall portion 232, 234, 236, 238 preferably includes plurality of radial sections 238*a*, 238*b* wherein each individual radial section 238*a*, 238*b* may be of constant thickness, or may increase in thickness or decrease in thickness with distance from the center portion 230. As will be understood to one of skill in the art, the change in thickness of the radial sections that increase or decrease in thickness may be linear or non-linear, and may be continuous or discontinuous. In the embodiment illustrated in FIG. 4, each wall portion 232, 234, 236, 238 includes two radial sections 238*a*, 238*b* which are configured such that the wall portions 232, 234, 236, 238 have a convex shaped cross-section.

As will be understood by one of skill in the art, the plurality of radial sections 238*a*, 238*b* may also be configured to produce wall portions 232, 234, 236, 238 with a wide variety cross-sectional shapes including, but not limited to, configurations that have a concave shaped cross-section and configurations that have a cross-section that alternates between convex shaped and concave shaped. As will also be understood by one of skill in the art the convex and concave cross-sections may be arcuate in shape or may be formed from a plurality of faces. As will be understood to one of skill in the art, two or more radial sections 238*a*, 238*b* can be used. These embodiments may allow for better control of the location of the twisted pairs within the compartments which may provide better separation between the twisted pairs which may, in turn, improve crosstalk performance at the possible expense of requiring more material which may increase manufacturing cost and may decrease cable flexibility. These embodiments may also be easier to manufacture.

Figure 5:
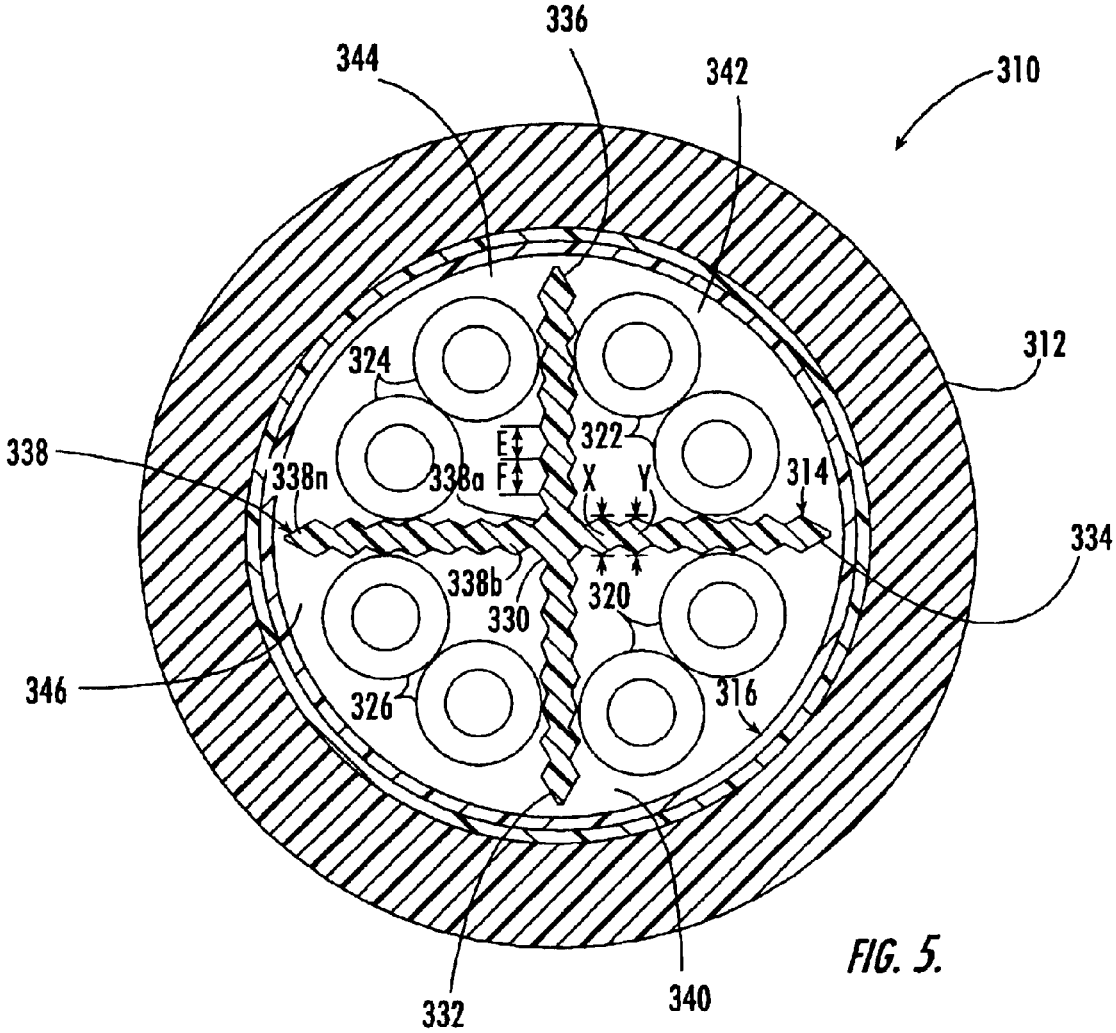
FIG. 5 is a cross-sectional view of still other embodiments of communications cables according to the present invention.

With reference to FIG. 5, a communications cable 310 according to further embodiments of the present invention will now be described. The communications cable 310 includes a cable jacket 312, a spacer 314, a plurality of twisted pairs of insulated conductors 320, 322, 324, 326, a shield 316 and a plurality of compartments 340, 342, 344, 346. It will, however, be understood that the shield 316 may be omitted. The cable jacket 312, the plurality of twisted pairs of insulated conductors 320, 322, 324, 326, the shield 316 and the plurality of compartments 340, 342, 344, 346 may generally be constructed in the same manner as the cable jacket 10, the plurality of twisted pairs of insulated conductors 20, 22, 24, 26, the shield 16 and the plurality of compartments 40, 42, 44, 46 described above with reference to the communications cable 10. Accordingly, a detailed description thereof need not be repeated.

As shown in FIG. 5, the spacer 314 is situated within and is longitudinally coextensive with the cable jacket 312. The spacer 314 may comprise the same materials and may be fabricated using the same fabrication techniques that were discussed in connection with the spacer 14. As illustrated in FIG. 5, the spacer 314 includes a longitudinally extending center portion 330 and a plurality of longitudinally extending wall portions 332, 334, 336, 338 radiating from the center portion 330. Each individual wall portion 332, 334, 336, 338 preferably includes a plurality of radial sections 338*a*, 338*b* . . . 338*n* wherein each individual radial section 338*a*, 338*b* . . . 338*n* may be of constant thickness, or may increase in thickness or decrease in thickness with distance from the center portion 330. As will be understood to one of skill in the art, the change in thickness of the radial sections that increase or decrease in thickness may be linear or non-linear, and may be continuous or discontinuous.

In the embodiment illustrated in FIG. 5, the plurality of radial sections 338*a*, 338*b* . . . 338*n* are configured such that the wall portions 332, 334, 336, 338 have a saw-toothed shaped cross-section wherein each individual tooth has a height X, Y and the teeth are spaced at a distance E, F. As will be understood by one of skill in the art, the height X, Y of each individual tooth may be equal to or may vary from the height X, Y of any other tooth and the distance E, F between teeth may be equal to or may vary from the distance E, F between any two other teeth. It will also be understood that the number of teeth may vary from the number shown in FIG. 5, and that the number of teeth may vary between wall portions 332, 334, 336, 338. These embodiments may allow for better control of the location of the twisted pairs within the compartments which may provide better separation between the twisted pairs which, in turn, may improve cross-talk performance. Additionally, these embodiments may produce a more flexible cable due to the possible accordion affect that may take place within the wall portions, all at the possible expense of adversely affecting manufacturing stability and possibly creating pinch points on the twisted pairs which may degrade impedance and return loss performance.

Figure 6:
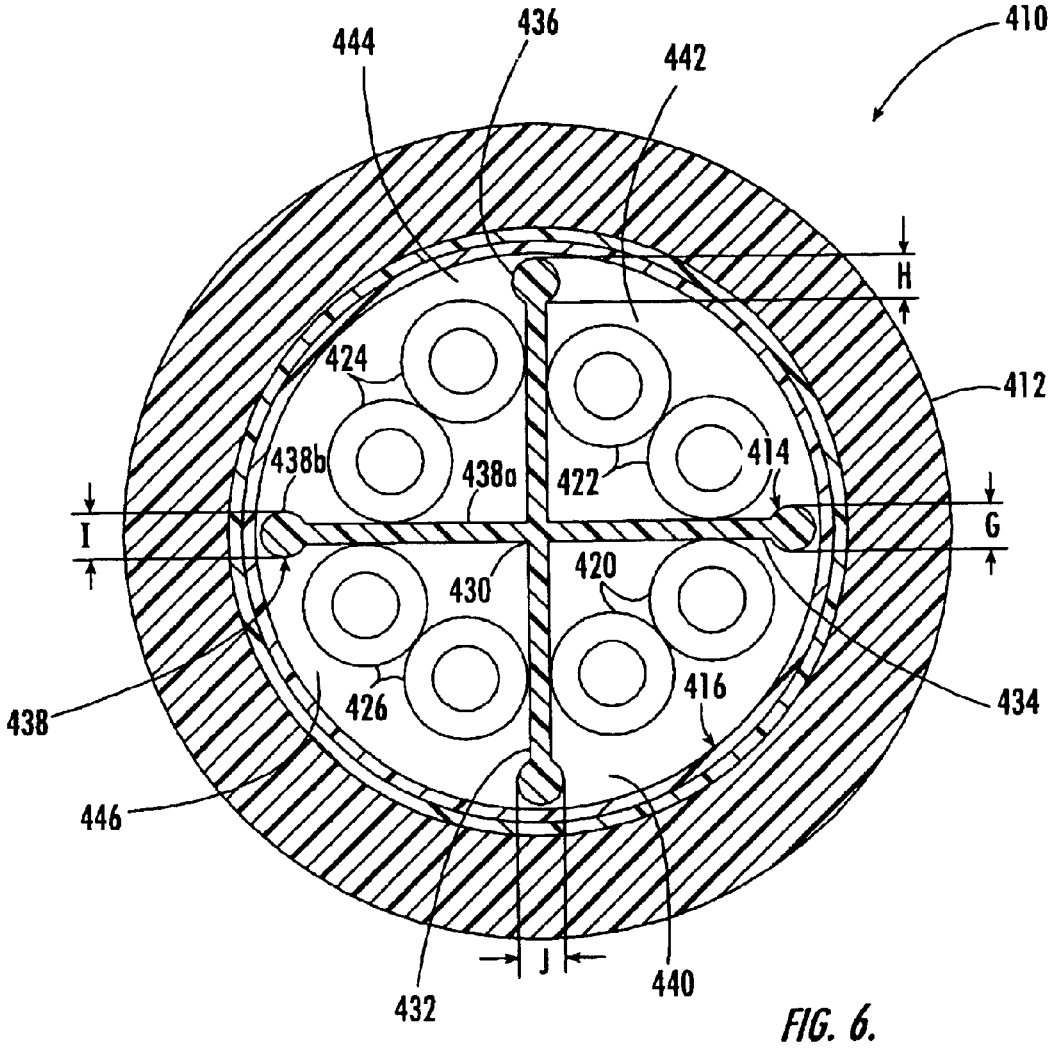
FIG. 6 is a cross-sectional view of still further embodiments of communications cables according to the present invention.

With reference to FIG. 6, a communications cable 410 according to further embodiments of the present invention will now be described. The communications cable 410 includes a cable jacket 412, a spacer 414, a plurality of twisted pairs of insulated conductors 420, 422, 424, 426, a shield 416 and a plurality of compartments 440, 442, 444, 446. It will, however, be understood that the shield 416 may be omitted. The cable jacket 412, the plurality of twisted pairs of insulated conductors 420, 422, 424, 426, the shield 416 and the plurality of compartments 440, 442, 444, 446 may generally be constructed in the same manner as the cable jacket 10, the plurality of twisted pairs of insulated conductors 20, 22, 24, 26, the shield 16 and the plurality of compartments 40, 42, 44, 46 described above with reference to the communications cable 10. Accordingly, a detailed description thereof need not be repeated.

As shown in FIG. 6, the spacer 414 is situated within and is longitudinally coextensive with the cable jacket 412. The spacer 414 may comprise the same materials and may be fabricated using the same fabrication techniques that were discussed in connection with the spacer 14. As illustrated in FIG. 6, the spacer 414 includes a longitudinally extending center portion 430 and a plurality of longitudinally extending wall portions 432, 434, 436, 438 radiating from the center portion 430. Each individual wall portion 432, 434, 436, 438 preferably includes plurality of radial sections 438*a*, 438*b* wherein each individual radial section 438*a*, 438*b* may be of constant thickness, may increase in thickness or decrease in thickness with distance from the center portion 430, or may have a knob shaped cross-section. As will be understood to one of skill in the art, the change in thickness of the radial sections that increase or decrease in thickness may be linear or non-linear, and may be continuous or discontinuous. In the embodiment illustrated in FIG. 6, each wall portion 432, 434, 436, 438 includes two radial sections 438*a*, 438*b* with the first radial section 438*a* being of constant thickness and the second radial section 438*b* having a knob shaped cross-section and a size G, H, I, J. Although the knob shaped radial section in FIG. 6 is a whole knob, one of skill in the art will understand that the knob shaped radial section may consist of only a portion of a knob including a half knob and that the size G, H, I, J of a knob may be the same or may vary between knobs.

As will be also understood by one of skill in the art, the plurality of radial sections 438*a*, 438*b* may also be configured to produce wall portions 432, 434, 436, 438 with a wide variety of shapes including, but not limited to, configurations that include multiple knob shaped radial sections and configurations that include knob shaped radial sections combined with radial sections that increase in thickness and/or radial sections that decrease in thickness and/or radial sections of constant thickness. It will also be understood that the knobs need not be at the ends of the spacer. These embodiments may restrain the twisted pairs from becoming too close to the cable jacket which may make the cable easier to manufacture at the possible expense of allowing the twisted pairs to move closer together which may decrease crosstalk performance. These embodiments may also provide increased surface contact between the spacer and the cable jacket or, if included, the shield, which may better protect the twisted pairs during the process of stripping the cable jacket and/or shield away, and may reduce the possibility that the twisted pairs will slip out of their respective compartments during manufacturing which may increase the stability of the cable.

Figure 7:
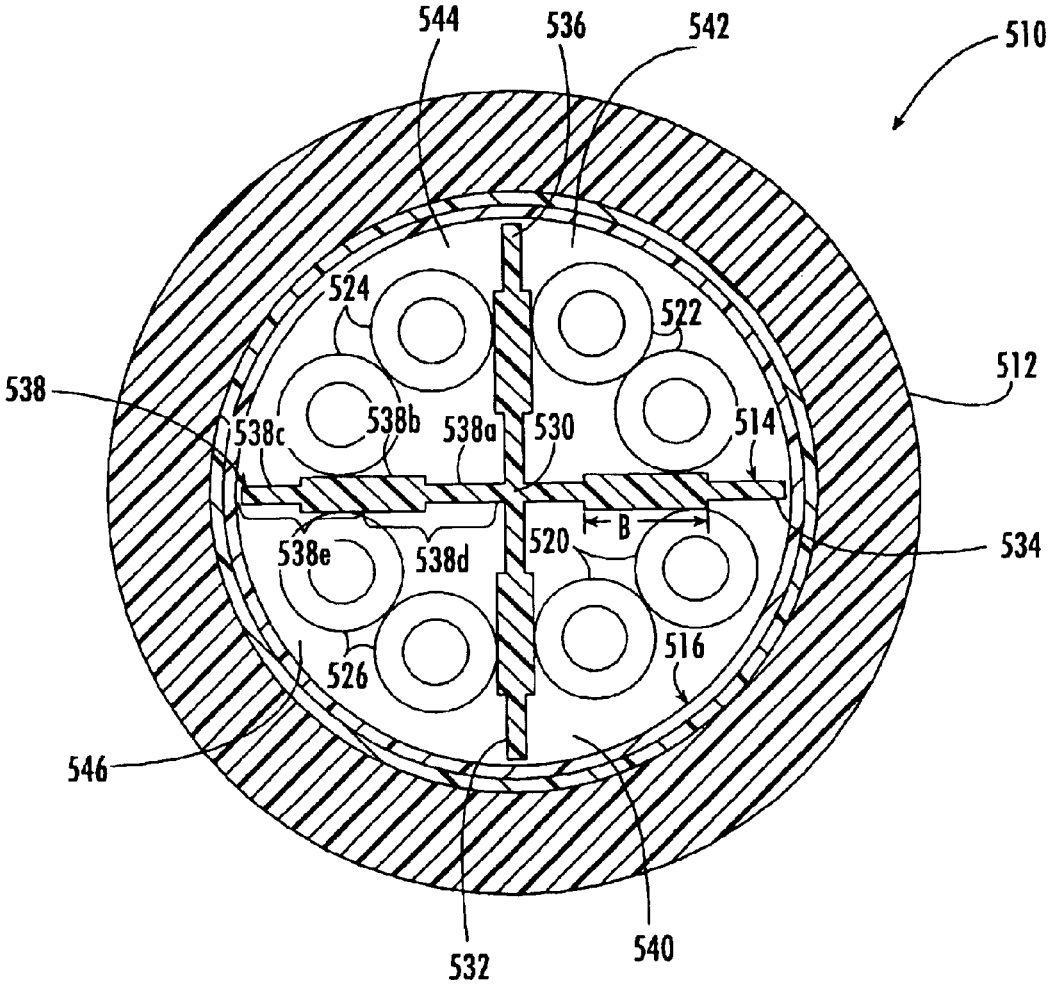
FIG. 7 is a cross-sectional view of still other embodiments of communications cables according to the present invention.

With reference to FIG. 7, a communications cable 510 according to further embodiments of the present invention will now be described. The communications cable 510 includes a cable jacket 512, a spacer 514, a plurality of twisted pairs of insulated conductors 520, 522, 524, 526, a shield 516 and a plurality of compartments 540, 542, 544, 546. It will, however, be understood that the shield 516 may be omitted. The cable jacket 512, the plurality of twisted pairs of insulated conductors 520, 522, 524, 526, the shield 516 and the plurality of compartments 540, 542, 544, 546 may generally be constructed in the same manner as the cable jacket 10, the plurality of twisted pairs of insulated conductors 20, 22, 24, 26, the shield 16 and the plurality of compartments 40, 42, 44, 46 described above with reference to the communications cable 10. Accordingly, a detailed description thereof need not be repeated.

As shown in FIG. 7, the spacer 514 is situated within and is longitudinally coextensive with the cable jacket 512. The spacer 514 may comprise the same materials and may be fabricated using the same fabrication techniques that were discussed in connection with the spacer 14. As illustrated in FIG. 7, the spacer 514 includes a longitudinally extending center portion 530 and a plurality of longitudinally extending wall portions 532, 534, 536, 538 radiating from the center portion 530. Each individual wall portion 532, 534, 536, 538 preferably includes plurality of radial sections 538*a*, 538*b*, 538*c* wherein each individual radial section 538*a*, 538*b*, 538*c* may be of constant thickness, or may increase in thickness or decrease in thickness with distance from the center portion 530. As will be understood to one of skill in the art, the change in thickness of the radial sections that increase or decrease in thickness may be linear or non-linear, and may be continuous or discontinuous. In the embodiment illustrated in FIG. 7, each wall portion 532, 534, 536, 538 includes three radial sections 538*a*, 538*b*, 538*c* which are configured such that the middle radial section 538*b* is thicker than the other two radial sections 538*a*, 538*c* thus forming a ribbed portion. Alternatively, the embodiment illustrated in FIG. 7 may also be described as including two radial sections 538*d*, 538*e*, one that increases in thickness in a discontinuous manner 538*d* with distance from the center portion 530 and one that decreases in thickness in a discontinuous manner 538*e* with distance from the center portion 530, which are configured such that the wall portions 532, 534, 536, 538 have a ribbed portion.

As will be understood by one of skill in the art, the width B of a ribbed portion for any one wall portion 532, 534, 536, 538 may be the same as or may vary from the width B of a ribbed portion for any other wall portion 532, 534, 536, 538. It will also be understood that there may be multiple ribbed portions. These embodiments may increase twisted pair separation by increasing the thickness of the wall portions located adjacent to the twisted pairs which may improve crosstalk performance at the possible expense of moving the twisted pairs undesirably close to the cable jacket and/or shield which may adversely affect return loss, impedance and attenuation. These embodiments may also reduce the amount of material in the center portion which may increase cable flexibility.

Figure 8:
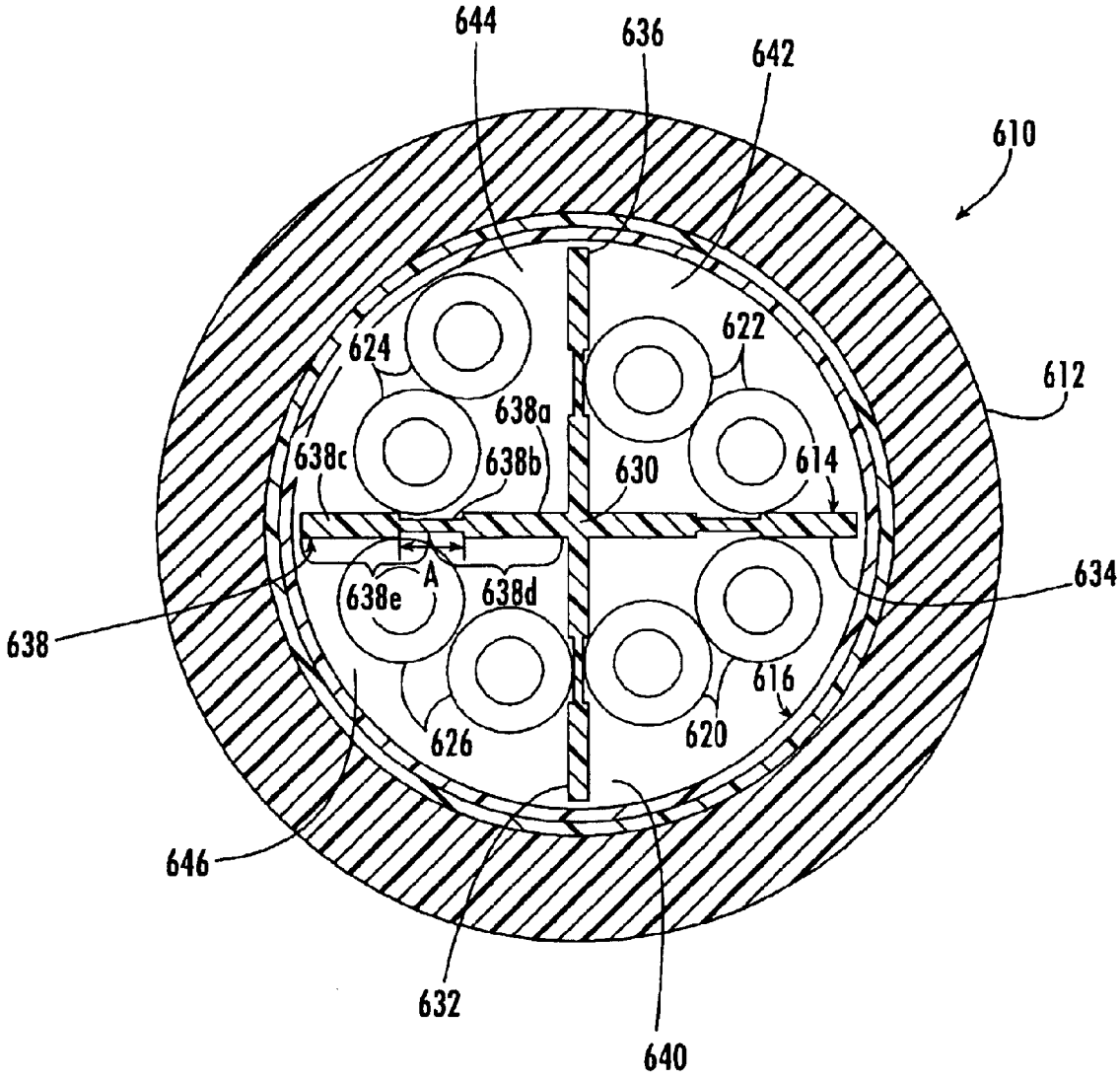
FIG. 8 is a cross-sectional view of still further embodiments of communications cables according to the present invention.

With reference to FIG. 8, a communications cable 610 according to further embodiments of the present invention will now be described. The communications cable 610 includes a cable jacket 612, a spacer 614, a plurality of twisted pairs of insulated conductors 620, 622, 624, 626, a shield 616 and a plurality of compartments 640, 642, 644, 646. It will, however, be understood that the shield 616 may be omitted. The cable jacket 612, the plurality of twisted pairs of insulated conductors 620, 622, 624, 626, the shield 616 and the plurality of compartments 640, 642, 644, 646 may generally be constructed in the same manner as the cable jacket 10, the plurality of twisted pairs of insulated conductors 20, 22, 24, 26, the shield 16 and the plurality of compartments 40, 42, 44, 46 described above with reference to the communications cable 10. Accordingly, a detailed description thereof need not be repeated.

As shown in FIG. 8, the spacer 614 is situated within and is longitudinally coextensive with the cable jacket 612. The spacer 614 may comprise the same materials and may be fabricated using the same fabrication techniques that were discussed in connection with the spacer 14. As illustrated in FIG. 8, the spacer 614 includes a longitudinally extending center portion 630 and a plurality of longitudinally extending wall portions 632, 634, 636, 638 radiating from the center portion 630. Each individual wall portion 632, 634, 636, 638 preferably includes plurality of radial sections 638*a*, 638*b*, 638*c* wherein each individual radial section 638*a*, 638*b*, 638*c* may be of constant thickness, or may increase in thickness or decrease in thickness with distance from the center portion 630. As will be understood to one of skill in the art, the change in thickness of the radial sections that increase or decrease in thickness may be linear or non-linear, and may be continuous or discontinuous. In the embodiment illustrated in FIG. 8, each wall portion 632, 634, 636, 638 includes three radial sections 638*a*, 638*b*, 638*c* which are configured such that the middle radial section 638*b* is thinner than the other two radial sections 638*a*, 638*c* thus forming a recessed portion. Alternatively, the embodiment illustrated in FIG. 8 may also be described as including two radial sections 638*d*, 638*e*, one that decreases in thickness in a discontinuous manner 638*d* with distance from the center portion 630 and one that increases in thickness in a discontinuous manner 638*e* with distance from the center portion 630, which are configured such that the wall portions 632, 634, 636, 638 have a recessed portion.

As will be understood by one of skill in the art, the width A of a recessed portion for any one wall portion 632, 634, 636, 638 may be the same as or may vary from the width A of a recessed portion for any other wall portion 632, 634, 636, 638. It will also be understood that there may be multiple recessed portions. These embodiments may allow for better control of the location of the twisted pairs within the compartments which may provide better separation between the twisted pairs which, in turn, may improve crosstalk performance at the possible expense of adversely affecting return loss. These embodiments may also use more material which may decrease cable flexibility, and may increase the probability that the wall portions will fold over which may allow the twisted pairs to slip into an adjoining compartment.

It will be understood that the various geometric shapes (e.g., sawtooth shaped, knob shaped etc.) of the wall portions of the embodiments of the present invention illustrated in FIGS. 1–8 may be combined. For example, the knob shaped cross-section illustrated in FIG. 6 may be combined with the recessed shaped cross-section in FIG. 8 to form wall portions having both a recessed portion and a knob shaped portion. It will also be understood that a conventional rip cord and/or a drain wire may be included in any of the embodiments of the present invention.

Communications cables according to embodiments of the invention in operation may reduce, and preferably minimize, cross-talk between the twisted pairs of insulated conductors. Moreover, communications cables according to embodiments of the invention may reduce, and preferably minimize, capacitance imbalance as desired for such cables.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. It is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A communications cable comprising:

a cable jacket;

a spacer extending within the cable jacket, the spacer having a longitudinally extending center portion and plurality of longitudinally extending wall portions radiating from the center portion, the longitudinally extending wall portions increasing in thickness over only a portion thereof from the center portion to the cable jacket, the spacer and the cable jacket defining a plurality of compartments within the cable jacket; and a twisted pair of insulated conductors disposed in one of the plurality of compartments.

2. The communications cable according to claim 1 further comprising a plurality of twisted pairs of insulated conductors disposed in respective ones of the plurality of compartments.

3. The communications cable according to claim 2 wherein each of the plurality of twisted pairs of insulated conductors has a different lay length.

4. The communications cable according to claim 3 wherein the plurality of longitudinally extending wall portions are configured so as to define a plurality of compartments of a helical configuration within the cable jacket and the plurality of twisted pairs of insulated conductors located within the plurality of compartments extend helically about the longitudinal axis of the cable.

5. A communications cable comprising:

a cable jacket;

a spacer extending within said cable jacket, the spacer being formed of and having an outer surface of a polymeric material and having a longitudinally extending center portion and plurality of longitudinally extending wall portions radiating from said center portion such that the cross-section of the spacer is radially symmetric, the longitudinally extending wall portions having a first radial section that increases in thickness with distance from the center portion and a second radial section that decreases in thickness with distance from the center portion, the spacer and the cable jacket defining a plurality of compartments within the cable jacket; and a plurality of twisted pairs of insulated conductors, wherein each of the twisted pairs is disposed in a different one of the compartments;

wherein the compartments are configured such that distances between pairs of said twisted pairs of insulated conductors that are in diametrically opposed compartments are substantially the same.

6. The communications cable according to claim 5 wherein the first radial section is located between the center portion and the second radial section.

7. The communications cable according to claim 5 wherein the second radial section is located between the center portion and the first radial section.

8. The communications cable according to claim 5 wherein the first radial section and the second radial section are configured such that the plurality of longitudinally extending wall portions have a convex shaped cross-section.

9. The communications cable according to claim 8 wherein the convex shaped cross-section is arcuate.

10. The communications cable according to claim 8 wherein the convex shaped cross-section comprises a plurality of faces.

11. The communications cable according to claim 5 wherein the first radial section and the second radial section are configured such that the plurality of longitudinally extending wall portions have a concave shaped cross-section.

12. The communications cable according to claim 11 wherein the concave shaped cross-section is arcuate.

13. The communications cable according to claim 11 wherein the concave shaped cross-section comprises a plurality of faces.

14. The communications cable according to claim 5 wherein the first radial section and second radial section are configured such that the plurality of longitudinally extending wall portions have a recessed portion.

15. The communications cable according to claim 5 wherein the first radial section and second radial section are configured such that the plurality of longitudinally extending wall portions have a ribbed portion.

16. The communications cable according to claim 5 wherein the first radial section and the second radial section are configured such that the plurality of longitudinally extending wall portions have a sawtooth shaped cross-section.

17. A communications cable comprising:

a cable jacket;

a spacer extending within said cable jacket, the spacer being formed of a polymeric material and having a longitudinally extending center portion and plurality of longitudinally extending wall portions radiating from said center portion such that the cross-section of the spacer is radially symmetric, the longitudinally extending wall portions including a first section having a first thickness, a second section having a second thickness and a third section having a third thickness, the third thickness being different from the first and second thickness, the third section located between the first section and the second section, the spacer and the cable jacket defining a plurality of compartments within the cable jacket; and a plurality of twisted pairs of insulated conductors, wherein each of the twisted pairs is disposed in a different one of the compartments;

wherein the compartments are configured such that distances between pairs of said twisted pairs of insulated conductors that are in diametrically opposed compartments are substantially the same.

18. The communications cable of claim 17 wherein the first, second and third thickness are different from one another.

19. The communications cable of claim 17 wherein the first thickness and the second thickness are the same and the third thickness is different from the first thickness.

20. The communications cable of claim 19 wherein the third thickness is greater than the first thickness.

21. The communications cable of claim 19 wherein the third thickness is less than the first thickness.

22. A communications cable comprising:

a cable jacket;

a spacer extending within said cable jacket, the spacer having a longitudinally extending center portion and plurality of longitudinally extending wall portions radiating from said center portion such that the cross-section of the spacer is radially symmetric, the longitudinally extending wall portions having a convex shaped cross-section, the spacer and the cable jacket defining a plurality of compartments within the cable jacket; and a plurality of twisted pairs of insulated conductors, wherein each of the twisted pairs is disposed in a different one of the compartments;

wherein the compartments are configured such that distances between pairs of said twisted pairs of insulated conductors that are in diametrically opposed compartments are substantially the same.

23. The communication cable of claim 22 wherein the convex shaped cross-section is arcuate.

24. The communications cable of claim 22 where the convex shaped cross-section comprises a plurality of faces.

* * * * *